United States Patent [19]

Eheim, deceased

[11] Patent Number: 4,635,602

[45] Date of Patent: Jan. 13, 1987

[54] FUEL INJECTION PUMP FOR INTERNAL COMBUSTION ENGINES

[75] Inventor: Franz Eheim, deceased, late of Stuttgart, Fed. Rep. of Germany, by Helga Eheim, heir

[73] Assignee: Robert Bosch GmbH, Stuttgart, Fed. Rep. of Germany

[21] Appl. No.: 759,790

[22] Filed: Jul. 29, 1985

[30] Foreign Application Priority Data

Aug. 21, 1984 [DE] Fed. Rep. of Germany ..... 3430654

[51] Int. Cl.[4] ..... F02M 39/00

[52] U.S. Cl. ..... 123/357; 123/449; 123/503

[58] Field of Search ..... 123/357–359, 123/449, 503; 74/603, 604

[56] References Cited

U.S. PATENT DOCUMENTS

| | | | |
|---|---|---|---|
| 2,256,605 | 9/1941 | Bier | 74/603 |
| 2,524,207 | 10/1950 | Palmer | 74/603 |
| 3,630,643 | 12/1971 | Eheim | 123/357 |
| 4,325,337 | 4/1982 | Eheim | 123/357 |
| 4,380,221 | 4/1984 | Eheim | 123/357 |
| 4,393,835 | 7/1983 | Eheim | 123/357 |
| 4,423,485 | 12/1983 | Sami | 123/357 |
| 4,442,810 | 4/1984 | Eheim | 123/357 |
| 4,461,255 | 7/1984 | Eheim | 123/357 |
| 4,465,044 | 8/1984 | Yasuhara | 123/357 |

FOREIGN PATENT DOCUMENTS

| | | | |
|---|---|---|---|
| 2845139 | 4/1980 | Fed. Rep. of Germany | 123/357 |

*Primary Examiner*—Carl Stuart Miller

*Attorney, Agent, or Firm*—Edwin E. Greigg

[57] ABSTRACT

A fuel injection pump of the distributor pump type is proposed, in which the fuel quantity is governed with the aid of an annular slide displaceable on the pump piston. The annular slide is shifted by an electromechanical final control element. The shifting is effected via a shaft to which a connecting element is connected with an eccentricity (E); the connecting element is coupled to the annular slide. For balancing the mass of the thus eccentrically articulated annular slide, a counterweight is secured on the shaft.

1 Claim, 2 Drawing Figures

FUEL INJECTION PUMP FOR INTERNAL COMBUSTION ENGINES

BACKGROUND OF THE INVENTION

The invention is directed to improvements in fuel injection pumps. A fuel injection pump of this type, known from German Offenlegungsschrift 28 45 139, has the disadvantage that the electromechanical final control element is imbalanced in terms of its rotating mass joined to the shaft, because the annular slide is eccentrically articulated on the other end of the shaft, via the connecting member; hence axially directed acceleration forces exerted upon the annular slide can cause governor disruptions. Such acceleration forces are brought about in association with the axially operated piston type pump supplied by the fuel injection pump, and as a result of free moments of the Diesel engine in the motor vehicle.

OBJECTS AND SUMMARY OF THE INVENTION

It is an object of the fuel injection pump according to the invention to provide the advantage over the prior art that the mass of the annular slide is counteracted by a counterweight; thus, to the extent that the acceleration forces have a negative effect on the governor behavior, these forces can be eliminated by embodiment of the counterweight in a particular fashion disclosed herein.

It is another object to provide a particularly compact counterweight shape, which is readily oriented and calculated for use.

It is a further object of the invention to provide a counterweight which in concept revealed protrudes into the fuel-filled interior of the fuel injection pump, the counterweight being located immediately in the vicinity of the annular slide, with a torsionally rigid connection therebetween.

It is still another object to provide that the movement of the counterweight is hydraulically damped.

It is yet another object to provide an alternate, still more space-saving embodiment in which it is provided that the counterweight is disposed on the drive end of the shaft and simultaneously assumes the function of the movable element of a position transducer.

The invention will be better understood and further objects and advantages thereof will become more apparent from the ensuring detailed description of a preferred embodiment taken in conjunction with the drawings.

DESCRIPTION OF THE PREFERRED EMBODIMENT

Figure 1:
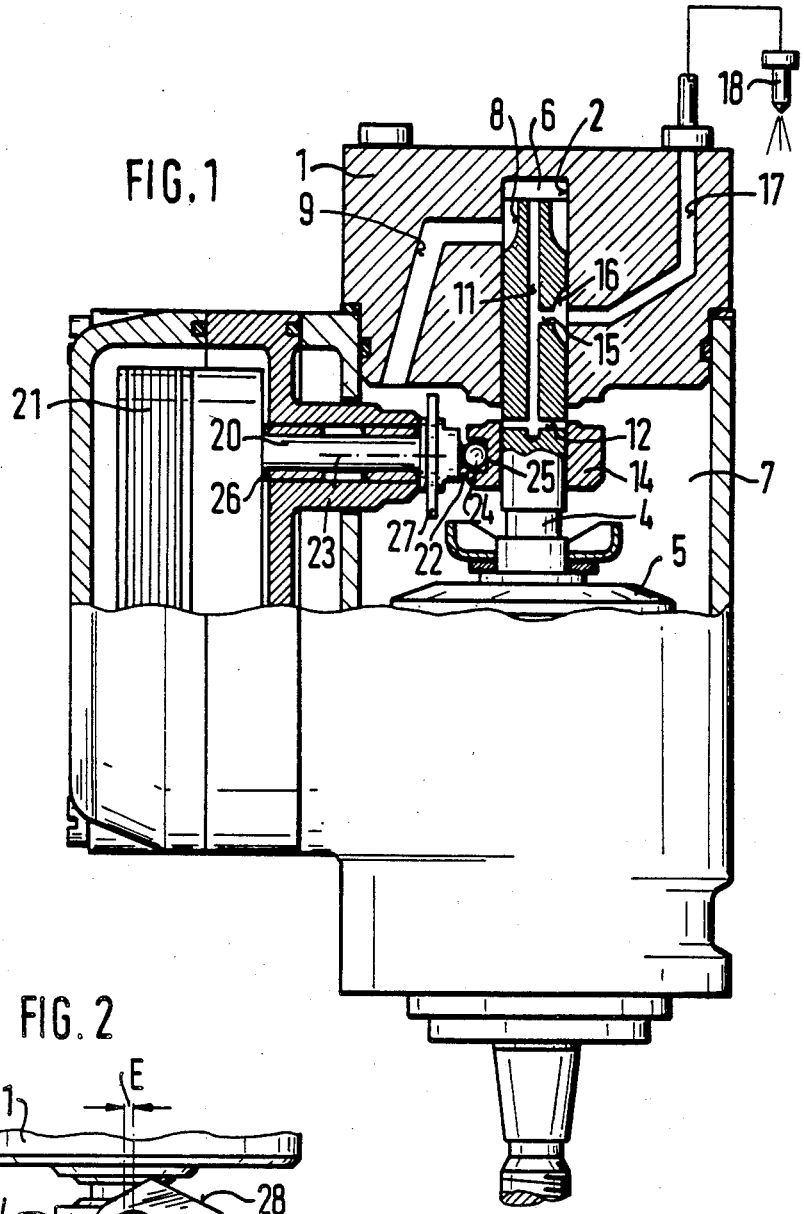
FIG. 1 shows in cross section the portion of a fuel injection pump that is essential to the invention, in a side view.

A pump piston 4 is disposed in a cylinder 2 in a housing 1 of a fuel injection pump and is set into simultaneously reciprocating and rotary motion by means of a cam disk 5 via a drive shaft and a roller path, not otherwise shown, but all of which is known from the prior art. On one end face, the pump piston 4 encloses a pump work chamber 6 within the cylinder 2 and protrudes partway out of the cylinder 2 into a pump suction chamber 7. The drive of the pump piston 4 is also effected at that end as is also well-known.

The pump work chamber 6 is supplied with fuel during the suction stroke of the pump piston 4 via longitudinal grooves 8 disposed in the jacket face of the pump piston 4 and via an intake line 9. The longitudinal grooves 8 open up the mouth of the intake line 9 into the cylinder 2. The intake line 9 communicates with the pump suction chamber 7, which is supplied by means not further shown with fuel at a relatively low pressure and which serves as a relief chamber.

A longitudinal conduit 11 in the pump piston 4 leads away from the work chamber 6, being arranged to merge with a transverse conduit 12 on the portion of the pump piston 4 that protrudes into the pump suction chamber 7. The transverse conduit 12 discharges at the jacket face of the pump piston 4 and together with the longitudinal conduit 11 acts as a relief conduit, the opening of which at the jacket face is controlled by an annular slide 14 that is displaceable on the pump piston 4. The upper edge of the annular slide 14 serves as the control edge. A radial bore 15, which discharges into a distributor groove 16, also branches off from the longitudinal conduit 11. Injection lines 17 which lead to the individual injection nozzles 18 branch off from the cylinder 2 in the operative vicinity of the groove 16, corresponding in number and distribution to the cylinder of the engine that are to be supplied.

The pump stroke at which the relief conduit outlet is opened and at which the fuel further positively displaced by the pump piston 4 flows out toward the suction chamber 7 is determined during a supply stroke of the pump piston 4 by means of the position of the annular slide 14. Beyond this stroke, the fuel injection is interrupted, and thus the fuel quantity pumped to the injection nozzles 18 is determined by the stroke position of the annular slide 14. The higher the annular slide 14, shown in FIG. 1, is shifted with respect to top dead center of the pump piston 4, the larger is the quantity of fuel that is injected.

Figure 2:
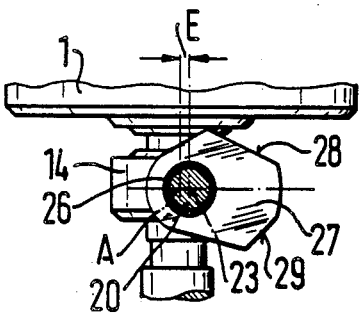
FIG. 2 is a section at right angles to that of FIG. 1, showing a plan view of the counterweight.

The position of the annular slide 14 is adjusted by a shaft 20, one end of which is connected with a rotary magnet 21 and on the other end has a ball head 24 seated on its end face 22 eccentrically with respect to the shaft axis 23. The ball head 24, as a connecting element, protrudes into a recess 25 of the annular slide 14, which is thus displaced axially on the pump piston 4 in a known manner by means of a rotary movement of the shaft 20. In the section shown in FIG. 2, this eccentricity is indicated by the symbol E, although the ball head 24 itself is not shown here. The symbol A represents the articulation point of the ball head 24, and 23 indicates the axis of the shaft 20, which is supported in a bushing 26 inserted in the wall of the housing 1.

At the end of the shaft 20 which protrudes out of the bushing 26 into the suction chamber 7, a counterweight 27, embodied in disk-like shape, is attached in a form-fitting or positively engaged manner, extending substantially diametrically with respect to the articulation point A. The counterweight 27 has limiting faces 28 and 29, which are arranged such that they permit adjoining parts to approach one another as closely as possible while enabling maximum deflection of the shaft 20, which results in a compact embodiment of the counterweight 27.

With the aid of this counterweight 27, the mass of the annular slide 14 that eccentrically engages the shaft 20 is at least partly compensated for, and depending on the embodiment of the counterweight 27, a particularly good compensation or balance can be achieved in selected positions. Acceleration forces which act upon the annular slide during fuel injection pump operation and which can cause disruptive reverse torque at the rotary magnet 21 are thereby reduced. It is advantageous in this respect if the counterweight 27 is disposed in the immediate vicinity of the annular slide 14, so that no notable torsion between the two elements can arise. At the same time, the movement of the counterweight 27 is damped by the fuel in the suction chamber 7 upon a rotation thereof.

The counterweight 27 may also, however, be disposed on the other end of the shaft 20 and embodied such that it acts as the movable part of a position transducer for the rotational position of the shaft 20. Thus when the rotational position of the shaft 20 is fed back as required, it is simultaneously possible to effect a balancing of the masses for the annular slide.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a housing, a pump piston therein arranged to reciprocate in a cylinder, said pump piston adapted to enclose in said cylinder a pump work chamber which communicates constantly with a relief line that discharges into a relief chamber, an annular slide on said pump piston having a control edge which opens and closes said relief line, said annular slide being adjustable relative to said pump piston and actuatable by means of a shaft having an axis, said shaft further being driven at one end by an electromechanical final control element and at another end said shaft being coupled with said annular slide via an eccentrically disposed connecting element and a counterweight positioned on said shaft, said counterweight comprising a disk-like member positioned proximate to said eccentrically disposed connecting element so as to protrude into said relief chamber of said fuel injection pump, said counterweight further having a center of gravity disposed upon a projection along an eccentricity E of the eccentrically disposed connecting element and said counterweight further comprises a position transducer secured to said shaft relative to said electromechanical final control element, whereby said shaft is protected from being loaded by tilting moments occurring during engine operation.

* * * * *